US012110203B2

(12) United States Patent
Ando

(10) Patent No.: US 12,110,203 B2
(45) Date of Patent: Oct. 8, 2024

(54) SHEET STORAGE APPARATUS, IMAGE FORMING SYSTEM INCLUDING THE SHEET STORAGE APPARATUS, AND IMAGE FORMING APPARATUS

(71) Applicant: KYOCERA Document Solutions Inc., Osaka (JP)

(72) Inventor: Satoshi Ando, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 104 days.

(21) Appl. No.: 18/187,766

(22) Filed: Mar. 22, 2023

(65) Prior Publication Data

US 2023/0322509 A1 Oct. 12, 2023

(30) Foreign Application Priority Data

Mar. 25, 2022 (JP) ..... 2022-049345

(51) Int. Cl.

| | |
|---|---|
| ***B65H 3/48*** | (2006.01) |
| ***B65H 1/18*** | (2006.01) |
| ***B65H 3/06*** | (2006.01) |
| ***B65H 3/54*** | (2006.01) |
| ***B65H 3/66*** | (2006.01) |

(52) U.S. Cl.

CPC ..... *B65H 3/48* (2013.01); *B65H 1/18* (2013.01); *B65H 3/06* (2013.01); *B65H 3/54* (2013.01); *B65H 3/66* (2013.01); *B65H 2402/45* (2013.01); *B65H 2405/115* (2013.01); *B65H 2405/15* (2013.01); *B65H 2801/06* (2013.01)

(58) Field of Classification Search

CPC ..... B65H 3/48; B65H 3/14; B65H 2406/121; B65H 2406/1211; B65H 3/54; B65H 3/06; B65H 3/66; B65H 2801/06; B65H 2405/114; B65H 2405/1142; B65H 2405/11425; B65H 2405/1144

See application file for complete search history.

(56) References Cited

U.S. PATENT DOCUMENTS

| | | | | |
|---|---|---|---|---|
| 11,591,173 | B2 * | 2/2023 | Hatakawa | B65H 3/66 |
| 2003/0057633 | A1 | 3/2003 | Okazaki et al. | 271/109 |
| 2004/0178557 | A1 | 9/2004 | Okazaki et al. | 271/97 |
| 2020/0071102 | A1 | 3/2020 | Masuda | |

FOREIGN PATENT DOCUMENTS

| | | | |
|---|---|---|---|
| JP | 2003-063675 | A | 3/2003 |
| JP | 2020-037474 | A | 3/2020 |

* cited by examiner

*Primary Examiner* — Jeremy R Severson
(74) *Attorney, Agent, or Firm* — Stein IP, LLC

(57) ABSTRACT

Provided is a sheet storage apparatus including: an apparatus body; a sheet storage section; a top cover; a sheet feeding section; a restricting cursor; a blowing device; a sheet holding-down member; and a moving mechanism. The sheet storage section includes a sheet supply port, and a sheet stacking portion. The top cover is pivotable to an opening position and to a closing position. The blowing device includes a fan and a vent. The sheet holding-down member includes a restricting piece. The moving mechanism is coupled to the sheet holding-down member, moves the sheet holding-down member to a restricting position by coming into contact with the top cover under a state in which the top cover has come to the closing position, and moves the sheet holding-down member to a retracted position by separating from the top cover when the top cover is moved to the opening position.

8 Claims, 8 Drawing Sheets

SHEET STORAGE APPARATUS, IMAGE FORMING SYSTEM INCLUDING THE SHEET STORAGE APPARATUS, AND IMAGE FORMING APPARATUS

INCORPORATION BY REFERENCE

This application is based on and claims the benefit of priority from Japanese Patent Application No. 2022-049345 filed on Mar. 25, 2022, the contents of which are hereby incorporated by reference.

BACKGROUND

The present disclosure relates to a sheet storage apparatus, an image forming system including the sheet storage apparatus, and to an image forming apparatus.

Hitherto, image forming systems that execute various processes including image formation in series have been known. As an example of such image forming systems, there is an image forming system including an image forming apparatus (such as a copying machine, a printer, or a facsimile machine) and a sheet storage apparatus. The sheet storage apparatus is configured to be capable of storing sheets therein in units of thousands. The sheet storage apparatus is arranged on a lateral side of the image forming apparatus, and is configured to be capable of feeding the sheets to an image forming section in the image forming apparatus.

As an example of such sheet storage apparatuses, there is a sheet storage apparatus that uses air in feeding the sheets. Such a sheet storage apparatus includes an apparatus body, a sheet storage section, a top cover, a sheet feeding section, a blowing device, and a sheet holding-down member.

A supply port for supplying the sheets is formed at a top of the apparatus body. The sheet storage section communicates to the supply port. The sheet storage section is capable of storing the sheets through the supply port. The top cover is supported, by the apparatus body, to be pivotable to a closing position (a position at which the supply port is closed) and to an opening position (a position at which the supply port is opened). At a predetermined position in an upward-and-downward direction (a feeding position), the sheet feeding section feeds the sheets to a downstream side in a sheet conveying direction (to a side where the image forming apparatus is present). The blowing device blows air along a sheet width direction toward the sheets in the sheet storage section. With this, among the sheets, ones disposed in a top portion of a bundle of the sheets are floated.

In this context, as an example of the sheet holding-down member of the sheet storage apparatus as described above, there is a sheet holding-down member fixed to a rear surface of the top cover (a surface on a side where the sheet storage section is present). Under a state in which the top cover has come to the closing position, this sheet holding-down member abuts against the sheets floated by the blowing device, to thereby restrict the floating of the sheets at the feeding position.

As another example of the sheet holding-down member of the sheet storage apparatus as described above, there is a sheet holding-down member provided, in the sheet storage section, to be movable in the upward-and-downward direction. This sheet holding-down member comes above the bundle of the sheets. This sheet holding-down member protrudes to an inner side in the sheet width direction relative to side edges of the sheets. Similar to the above-described one, this sheet holding-down member also abuts against the sheets floated by the blowing device, to thereby restrict the floating of the sheets at the feeding position.

SUMMARY

According to an aspect of the present disclosure, there is provided a sheet storage apparatus including: an apparatus body; a sheet storage section; a top cover; a sheet feeding section; a restricting cursor; a blowing device; a sheet holding-down member; and a moving mechanism.

The sheet storage section includes
- a sheet supply port that is formed at a top of the apparatus body, and
- a sheet stacking portion that is capable of stacking sheets, the sheets being capable of being stacked onto the sheet stacking portion through the sheet supply port.

The top cover supported by the apparatus body so as to be pivotable between
- an opening position at which the sheet supply port is opened and
- a closing position at which the top cover closes the sheet supply port by turning at a predetermined angle from the opening position.

The sheet feeding section
- is provided above the sheet storage section, and
- is configured to feed, at a predetermined feeding position, the sheets stacked on the sheet stacking portion toward a downstream side in a sheet conveying direction by abutting against the sheets.

The restricting cursor
- is arranged, in the sheet storage section, at a predetermined position in a sheet width direction orthogonal to the sheet conveying direction,
- has an abutment surface that abuts against side edges of the sheets, and
- is configured to restrict movements in the sheet width direction of the sheets stacked on the sheet stacking portion.

The blowing device includes
- a fan
  - that is provided in the restricting cursor, and
  - that is configured to generate airflow, and
- a vent
  - that is formed through the abutment surface, and
  - that is configured to exhaust the airflow, the blowing device being configured to blow the airflow to be exhausted through the vent to one of the sheets stacked on the sheet stacking portion, the one of the sheets having come near the predetermined feeding position, to thereby float the one of the sheets.

The sheet holding-down member
- is supported to be pivotable by the restricting cursor, and
- includes a restricting piece that is configured to restrict a floating height of the one of the sheets by coming into contact with a top surface of the one of the sheets by protruding from the abutment surface of the restricting cursor to an inner side in the sheet width direction.

The moving mechanism
- is coupled to the sheet holding-down member,
- is configured to move the sheet holding-down member to a restricting position by coming into contact with the top cover under a state in which the top cover in the closing position, the restricting position being a position of the sheet holding-down member that has protruded from the abutment surface, and
- is configured to move the sheet holding-down member from the abutment surface to a retracted position by separating from the top cover a state which the top cover is in the opening position, the retracted position being on an outer side in the sheet width direction and being a position of the sheet holding-down member that has retracted.

DETAILED DESCRIPTION

Figure 1:
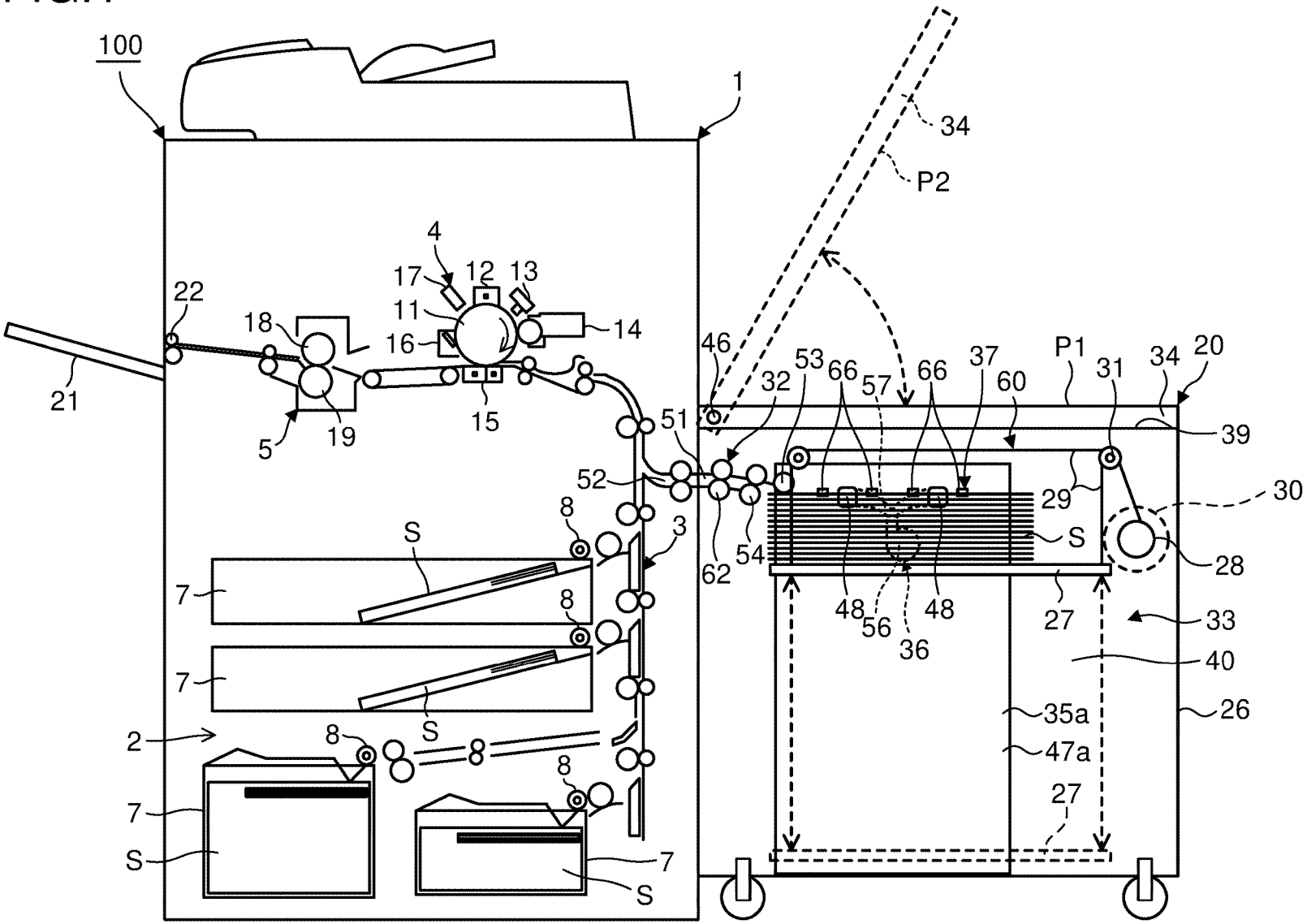
FIG. 1 is a schematic cross-sectional view of a schematic configuration of an image forming system including a sheet storage apparatus and an image forming apparatus according to an embodiment of the present disclosure.

Now, a sheet storage apparatus 20, an image forming apparatus 1, and an image forming system 100 including the sheet storage apparatus 20 and the image forming apparatus 1 according to an embodiment of the present disclosure are described with reference to the drawings. Note that, a direction in which sheets S are conveyed is referred to as a "sheet conveying direction," and a direction orthogonal to this sheet-S conveying direction (a direction perpendicular to the drawing sheet of FIG. 1, that is, an upward-and-downward direction shown in FIG. 3) is referred to as a "sheet width direction."

FIG. 1 is a schematic cross-sectional view of a schematic configuration of the image forming system 100 including the sheet storage apparatus 20 and the image forming apparatus 1 according to the embodiment of the present disclosure. As illustrated in FIG. 1, the image forming apparatus 1 includes a sheet feeding section 2, a sheet conveying path 3, an image forming section 4, and a fixing device 5.

The sheet feeding section 2 is disposed in a bottom portion of the image forming apparatus 1. The sheet feeding section 2 includes a plurality of sheet feeding cassettes 7 and a plurality of sheet feeding rollers 8. The sheet feeding cassettes 7 store the sheets S that are recording media such as plain sheets and envelopes. The sheet feeding cassettes 7 are inserted to be removable in a body part of the image forming apparatus 1. The sheet feeding rollers 8 are supported to be rotatable respectively on the sheet feeding cassettes 7. In the image forming apparatus 1, the sheet feeding rollers 8 rotate to feed the sheets S one by one from selected ones of the sheet feeding cassettes 7 into the sheet conveying path 3.

The sheet conveying path 3 is connected to the sheet feeding section 2. The sheet conveying path 3 conveys the sheets S fed from the sheet feeding cassettes 7 toward the image forming section 4. A delivery roller pair 22 is provided at a position on a most downstream side in the sheet conveying direction in the image forming apparatus 1. The fixing device 5 is arranged between the delivery roller pair 22 and the image forming section 4 in the sheet conveying direction.

On the sheet conveying path 3, a convergent path 52 communicates at a part on a downstream side in the sheet conveying direction relative to the sheet feeding section 2 and on an upstream side in the sheet conveying direction relative to the image forming section 4. The convergent path 52 opens in a side surface of the image forming apparatus 1.

The image forming section 4 forms toner images onto the sheets S by an electrophotographic process. The image forming section 4 includes a photosensitive member 11 supported in a pivotal manner to be rotatable in a direction of an arrow in FIG. 1, and includes, around the photosensitive member 11 along its rotation direction, a charging unit 12, an exposure unit 13, a developing device 14, a transfer unit 15, a cleaning unit 16, and a static eliminating unit 17.

The charging unit 12 includes a charging wire to which high voltage is applied. By corona discharge from this charging wire, a predetermined potential is generated on a surface of the photosensitive member 11. With this, the surface of the photosensitive member 11 is uniformly charged. The exposure unit 13 irradiates the photosensitive member 11 with light based on image data of originals. Then, the potential on the surface of the photosensitive member 11 is selectively attenuated, and electrostatic latent images are formed on the surface of the photosensitive member 11. The developing device 14 supplies toner onto the surface of the photosensitive member 11, and forms toner images (visible images) corresponding to the electrostatic latent images on the surface of the photosensitive member 11.

The transfer unit 15 faces the photosensitive member 11. Under the state in which the toner images have been formed on the surface of the photosensitive member 11, the transfer unit 15 transfers the toner images on the surface of the photosensitive member 11 onto the sheets S that have been conveyed to between the photosensitive member 11 and the transfer unit 15.

After the toner images have been transferred onto the sheets S, these sheets S are conveyed to the fixing device 5. The fixing device 5 includes a heating roller 18 and a pressure roller 19. The heating roller 18 and the pressure roller 19 are held in press contact with each other to form a fixing nip therebetween. The heating roller 18 and the pressure roller 19 heat and press the sheets S that have been conveyed to the fixing nip, to thereby melt and fix the toner images on the sheets S onto the sheets S. After the toner images have been fixed onto the sheets S, these sheets S are delivered onto a delivery tray 21 by the delivery roller pair 22.

The cleaning unit 16 removes residual toner on the surface of the photosensitive member 11 after the transfer. The static eliminating unit 17 removes residual charges on the surface of the photosensitive member 11 after the transfer. Then, the photosensitive member 11 is recharged by the charging unit 12. Subsequently, the image formation is repeated in the same way.

Next, the sheet storage apparatus 20 according to the embodiment of the present disclosure is described. Note that, hereinbelow, the sheet conveying direction refers to a direction in which the sheets S are conveyed from the sheet storage apparatus 20 to the convergent path 52 in the image forming apparatus 1.

Figure 2:
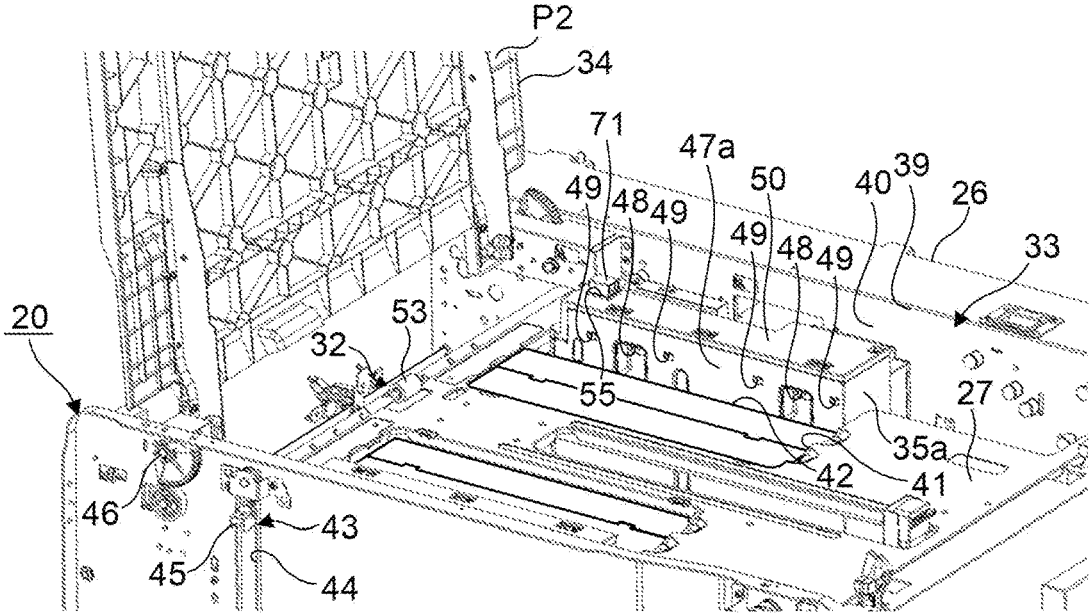
FIG. 2 is a perspective view of the sheet storage apparatus under a state in which a top cover has come to an opening position.
Figure 3:
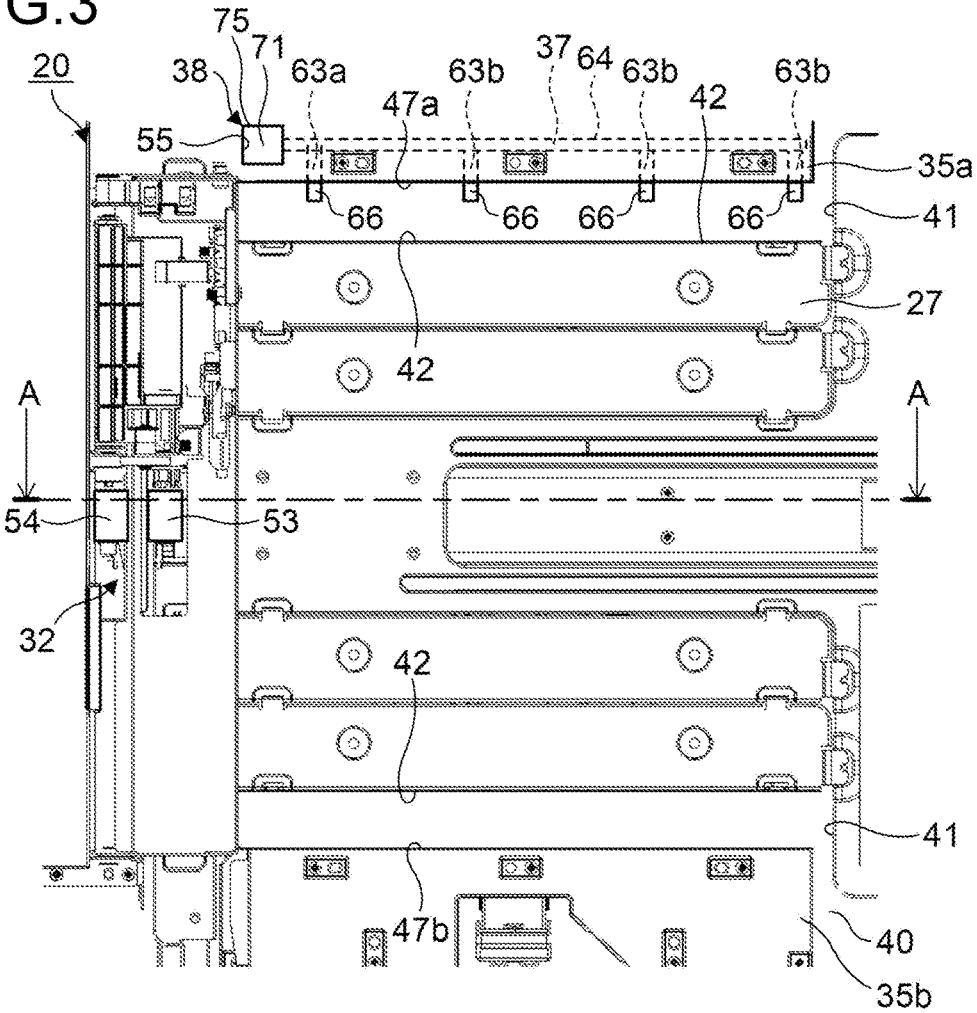
FIG. 3 is a front view of a sheet stacking tray as viewed from above.
Figure 4:
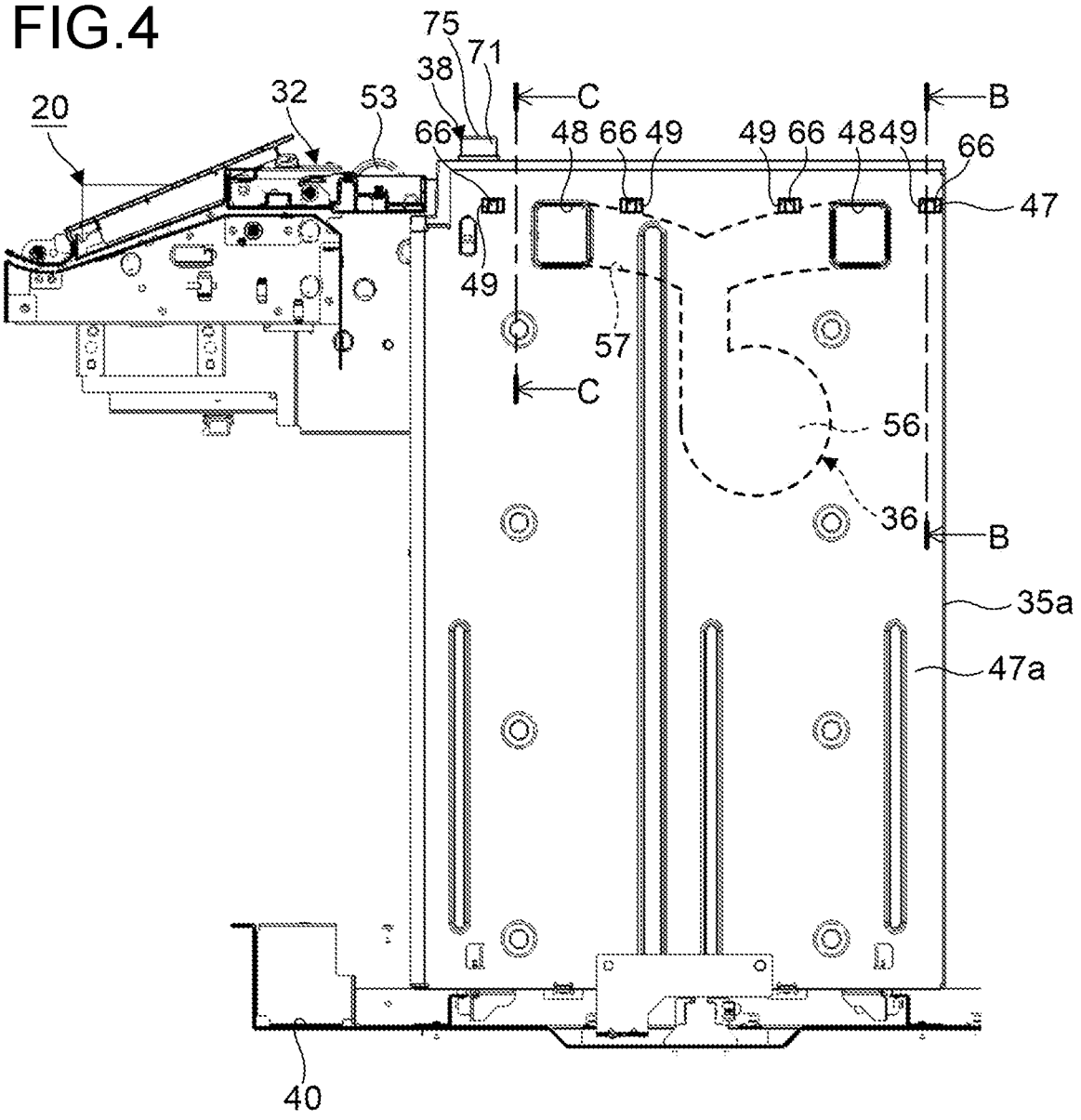
FIG. 4 is a cross-sectional view of the sheet storage apparatus as taken along a cross-section line A-A shown in FIG. 3.

FIG. 2 is a perspective view of the sheet storage apparatus 20 under a state in which a top cover 34 has come to an opening position. FIG. 3 is a front view of a sheet stacking tray 27 as viewed from above. As illustrated in FIG. 1, the sheet storage apparatus 20 is arranged adjacent to a lateral side of the image forming apparatus 1. The sheet storage apparatus 20 is capable of storing several thousands of the sheets S. FIG. 4 is a cross-sectional view of the sheet storage apparatus 20 as taken along a cross-section line A-A shown in FIG. 3. Note that, in FIG. 4, a housing 26, the sheet stacking tray 27, and a tray raising-and-lowering mechanism 60 are not illustrated.

As illustrated in FIG. 1 to FIG. 3, the sheet storage apparatus 20 includes the housing 26 (an apparatus body), a sheet storage section 33, the top cover 34, a sheet feeding section 32, restricting cursors 35*a* and 35*b*, a blowing device 36, a sheet holding-down member 37, and a moving mechanism 38.

The housing 26 is formed into a substantially rectangular-parallelepiped shape. The sheet storage section 33 is capable of storing therein the sheets S in units of thousands. The sheet storage section 33 includes a sheet supply port 39, a sheet storage space 40, the sheet stacking tray 27 (a sheet stacking portion), and the tray raising-and-lowering mechanism 60.

The sheet supply port 39 is an opening that is formed at a top of the housing 26. The sheet storage space 40 is a cubic space that is formed in the housing 26 and that expands downward from opening edges of the sheet supply port 39.

The sheet stacking tray 27 is stored in the sheet storage space 40. The sheet stacking tray 27 is a plate-like body capable of stacking the sheets S on its top surface. The sheet stacking tray 27 is formed to have a pair of cursor-receiving recessed portions 41 that are recessed inward from both edges in the sheet width direction. Edge portions disposed at bottoms of the cursor-receiving recessed portions 41 in the sheet width direction are referred to as positioning edge portions 42. The positioning edge portions 42 have a straight shape parallel to the sheet conveying direction.

As illustrated in FIG. 1, the sheet stacking tray 27 is supported, in the sheet storage space 40, to be capable of being raised and lowered by the tray raising-and-lowering mechanism 60. The tray raising-and-lowering mechanism 60 raises and lowers the sheet stacking tray 27 so that a top portion of a bundle of the sheets S stacked on the sheet stacking tray 27 overlaps with vents 48 described below in an upward-and-downward direction. As the bundle of the sheets S becomes lower as a result of feeding of a plurality of ones of the sheets S, the tray raising-and-lowering mechanism 60 raises the sheet stacking tray 27 in accordance therewith.

The tray raising-and-lowering mechanism 60 includes a plurality of wires 29, a plurality of relay pulleys 31, a take-up pully 28, a drive source 30, and a raising-and-lowering guide 43.

The relay pulleys 31 are supported to be rotatable above the sheet stacking tray 27 by the housing 26. One ends of the wires 29 are fixed to four corners of the sheet stacking tray 27. Other ends of the wires 29 are fixed to the take-up pully 28. At halfway positions between the one ends and the other ends, the wires 29 are independently looped around the relay pulleys 31.

The take-up pully 28 is connected to the drive source 30 such as a motor, and is rotated in any one of both forward and reverse directions by rotational driving force of the drive source 30. When the take-up pully 28 is rotated forward, the wires 29 are taken up around an outer peripheral surface of the take-up pully 28. With this, the sheet stacking tray 27 is raised. In contrast, when the take-up pully 28 is reversely rotated, the wires 29 are paid out from the take-up pully 28. With this, the sheet stacking tray 27 is lowered.

As illustrated in FIG. 2, the raising-and-lowering guide 43 includes a guide rail 44 and a guide protrusion 45. The guide rail 44 is a groove formed through a frame in the housing 26 and elongated in the upward-and-downward direction. The guide rail 44 is parallel to the upward-and-downward direction, and its groove width in the sheet conveying direction is uniform all over the upward-and-downward direction.

The guide protrusion 45 is a protrusion that protrudes in the sheet width direction from the edge in the sheet width direction of the sheet stacking tray 27. The guide protrusion 45 is inserted in the guide rail 44. When the sheet stacking tray 27 is raised and lowered, the guide protrusion 45 slides along inner-surface walls of the guide rail 44. In this way, the guide protrusion 45 guides the raising and the lowering of the sheet stacking tray 27 while restricting movements in the sheet conveying direction of the sheet stacking tray 27.

As illustrated in FIG. 1 and FIG. 2, at a top portion of the housing 26, the top cover 34 is supported to be pivotable to a closing position P1 and to an opening position P2. The closing position P1 is a position at which the top cover 34 closes the sheet supply port 39 and forms the top of the housing 26 (a position indicated by solid lines shown in FIG. 1). The opening position P2 is a position at which the sheet supply port 39 is opened by the top cover 34 that has turned at a predetermined angle from the closing position P1 (a position indicated by dashed lines shown in FIG. 1, and a position indicated by solid lines shown in FIG. 2).

A turning shaft 46 is provided at an end portion in the sheet conveying direction of the top cover 34, the end portion being on a side where the image forming apparatus 1 is present. The turning shaft 46 is a shaft body that protrudes in the sheet width direction from both edges of the top cover 34 to an outside. The turning shaft 46 is supported to be turnable relative to the housing 26. The top cover 34 pivots about the turning shaft 46 in a circumferential direction of the turning shaft 46.

As illustrated in FIG. 1 to FIG. 3, the sheet feeding section 32 is provided in the top portion of the housing 26. At a sheet feeding position, the sheet feeding section 32 feeds the sheets S stacked on the sheet stacking tray 27 toward the downstream side in the sheet conveying direction (the side where the image forming apparatus 1 is present). The sheet feeding position is a position at which a topmost one sheet S in the bundle of the sheets S stacked on the sheet stacking tray 27 abuts against a pick-up roller 53 described below (a position of a top surface of the bundle of the sheets S illustrated in FIG. 1).

The sheet feeding section 32 includes the pick-up roller 53, a sheet-feeding roller pair 54, a conveying roller pair 62, and a sheet delivery port 51. The pick-up roller 53 is disposed above the sheet stacking tray 27. The pick-up roller 53 faces the sheet stacking tray 27 in the upward-and-downward direction.

The sheet-feeding roller pair 54 is arranged on the downstream side in the sheet conveying direction relative to the pick-up roller 53. The conveying roller pair 62 is arranged on the downstream side in the sheet conveying direction relative to the sheet-feeding roller pair 54. The sheet delivery port 51 is disposed at an end portion of the sheet feeding section 32, the end portion being on the downstream side in the sheet conveying direction, and opens in a side surface of the housing 26.

When the pick-up roller 53 rotates in a feeding direction (a clockwise direction in FIG. 1) under a state in which the pick-up roller 53 is held in contact with the top surface of the sheet S, this sheet S is fed to the downstream side in the sheet conveying direction. The sheet-feeding roller pair 54 and the conveying roller pair 62 carry the sheet S that is fed by the pick-up roller 53 into the convergent path 52 through the sheet delivery port 51.

As illustrated in FIG. 2 to FIG. 4, the restricting cursors 35*a* and 35*b* are arranged in the sheet storage space 40. The restricting cursors 35*a* and 35*b* are arranged to face each other in the sheet width direction. The restricting cursors 35*a* and 35*b* are supported to be reciprocable in the sheet width direction at positions where the restricting cursors 35*a* and 35*b* overlap with the cursor-receiving recessed portions 41 in the sheet conveying direction (a right-and-left direction in FIG. 3).

In the sheet conveying direction, a length of each of the restricting cursors 35*a* and 35*b* is smaller than a width of each of the cursor-receiving recessed portions 41. In other words, when the restricting cursors 35*a* and 35*b* move in the sheet width direction toward a side where the sheet stacking tray 27 is present, the restricting cursors 35*a* and 35*b* advance into the cursor-receiving recessed portions 41. After the restricting cursors 35*a* and 35*b* have abutted against the positioning edge portions 42, further movements in the sheet width direction of the restricting cursors 35*a* and 35*b* toward the side where the sheet stacking tray 27 is present are restricted. Under a state in which the restricting cursors 35*a* and 35*b* have come to its outermost side in the sheet width direction, the restricting cursors 35*a* and 35*b* have come to an outer side relative to the sheet stacking tray 27.

Surfaces of the restricting cursors 35*a* and 35*b* (the side where the sheet stacking tray 27 is present), the surfaces being on an inner side in the sheet width direction (hereinafter, referred to as "inner surfaces 47*a* and 47*b*"), are flat surfaces orthogonal to the sheet width direction, that is, are flat surfaces parallel to the sheet conveying direction. In the sheet width direction, the inner surfaces 47*a* and 47*b* (abutment surfaces) face side edges of the sheets S stacked on the sheet stacking tray 27.

The plurality of (two in the illustration) vents 48 and a plurality of (four in the illustration) protruding-portion passing holes 49 are formed through the inner surface 47*a*. The vents 48 are aligned parallel to the sheet conveying direction. The vents 48 are disposed at positions overlapping with the pick-up roller 53 in the upward-and-downward direction. The protruding-portion passing holes 49 are aligned parallel to the sheet conveying direction. In the sheet conveying direction, two of the protruding-portion passing holes 49 are arranged on both sides of each of the vents 48. The protruding-portion passing holes 49 are disposed at positions overlapping with the pick-up roller 53 in the upward-and-downward direction.

When the restricting cursors 35*a* and 35*b* move inward in the sheet width direction (a side where the positioning edge portions 42 are present), the inner surfaces 47*a* and 47*b* abut against both the side edges of the sheets S. With this, movements in the sheet width direction of the sheets S are restricted. In this way, the bundle of the sheets S stacked on the sheet stacking tray 27 is positioned in the sheet width direction, and side edges of the bundle are aligned.

A top surface of the restricting cursor 35*a* (hereinafter, referred to as a "cursor top surface 50") is a horizontal flat surface. Under a state in which the top cover 34 has come to the closing position P1, the cursor top surface 50 faces a rear surface of the top cover 34 (a surface on a side where the sheet storage space 40 is present) in the upward-and-downward direction. A rectangular button-insertion hole 55 opens in the cursor top surface 50.

Figure 5:
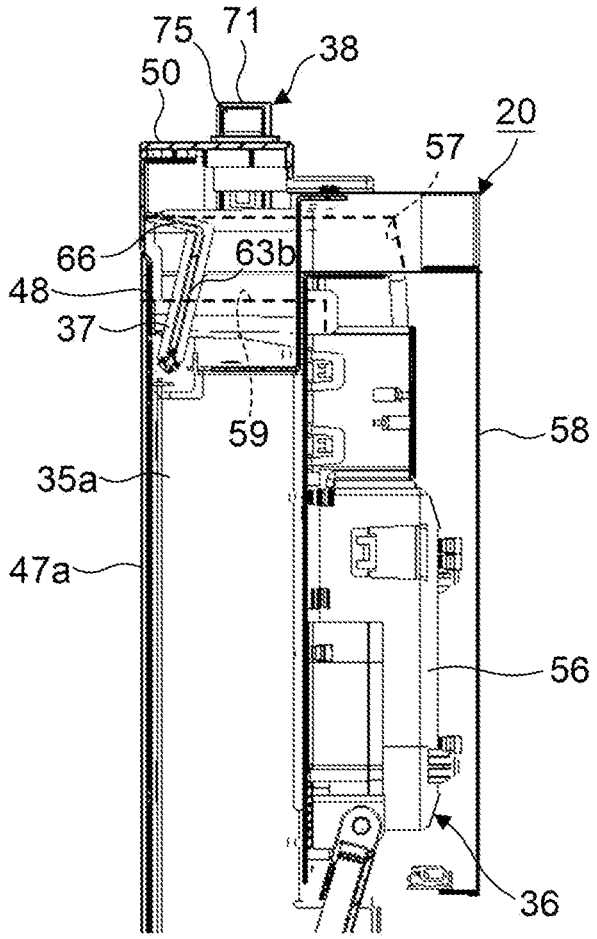
FIG. 5 is a cross-sectional view of the sheet storage apparatus as taken along a cross-section line B-B shown in FIG. 4.

FIG. 5 is a cross-sectional view of the sheet storage apparatus 20 as taken along a cross-section line B-B shown in FIG. 4. As illustrated in FIG. 4 and FIG. 5, the blowing device 36 includes the above-described vents 48, a fan 56, and a duct 57. The fan 56 is a sirocco fan mounted to a surface of the restricting cursor 35*a*, the surface being on a side opposite in the sheet width direction to the inner surface 47*a*.

A fan cover 58 is provided on the outside in the sheet width direction of the fan 56 (a side opposite to the sheet stacking tray 27). The fan cover 58 covers the fan 56 with the fan 56 interposed between the fan cover 58 and the restricting cursor 35*a*. The fan cover 58 is fixed to the restricting cursor 35*a*.

The duct 57 communicates to the fan 56 and the vents 48. The duct 57 is provided in the restricting cursor 35*a*. Air to be fed from the fan 56 is blown through the vents 48 via the duct 57. A straight portion 59 that extends parallel to the sheet width direction is provided at an end portion on a downstream side of the duct 57. The air to be fed from the fan 56 flows through the straight portion 59. With this, the air to be fed through the vents 48 is blown orthogonal to the side edges of the sheets S stacked on the sheet stacking tray 27.

As illustrated in FIG. 3 to FIG. 5, the sheet holding-down member 37 includes a plurality of hook portions 63*a* and 63*b* (restricting pieces) and a pivot shaft 64. The hook portions 63*a* and 63*b* are aligned in the sheet conveying direction (a horizontal direction). The hook portions 63*a* and 63*b* are arranged to overlap with the protruding-portion passing holes 49 in the sheet conveying direction. In other words, the hook portion 63*a* or 63*b* is arranged on each side of each of the vents 48. The pivot shaft 64 is supported, in the restricting cursor 35*a*, to be turnable in a circumferential direction of the pivot shaft 64. The pivot shaft 64 extends parallel to the sheet conveying direction. The hook portions 63*a* and 63*b* are connected integrally to the pivot shaft 64.

Figure 6:
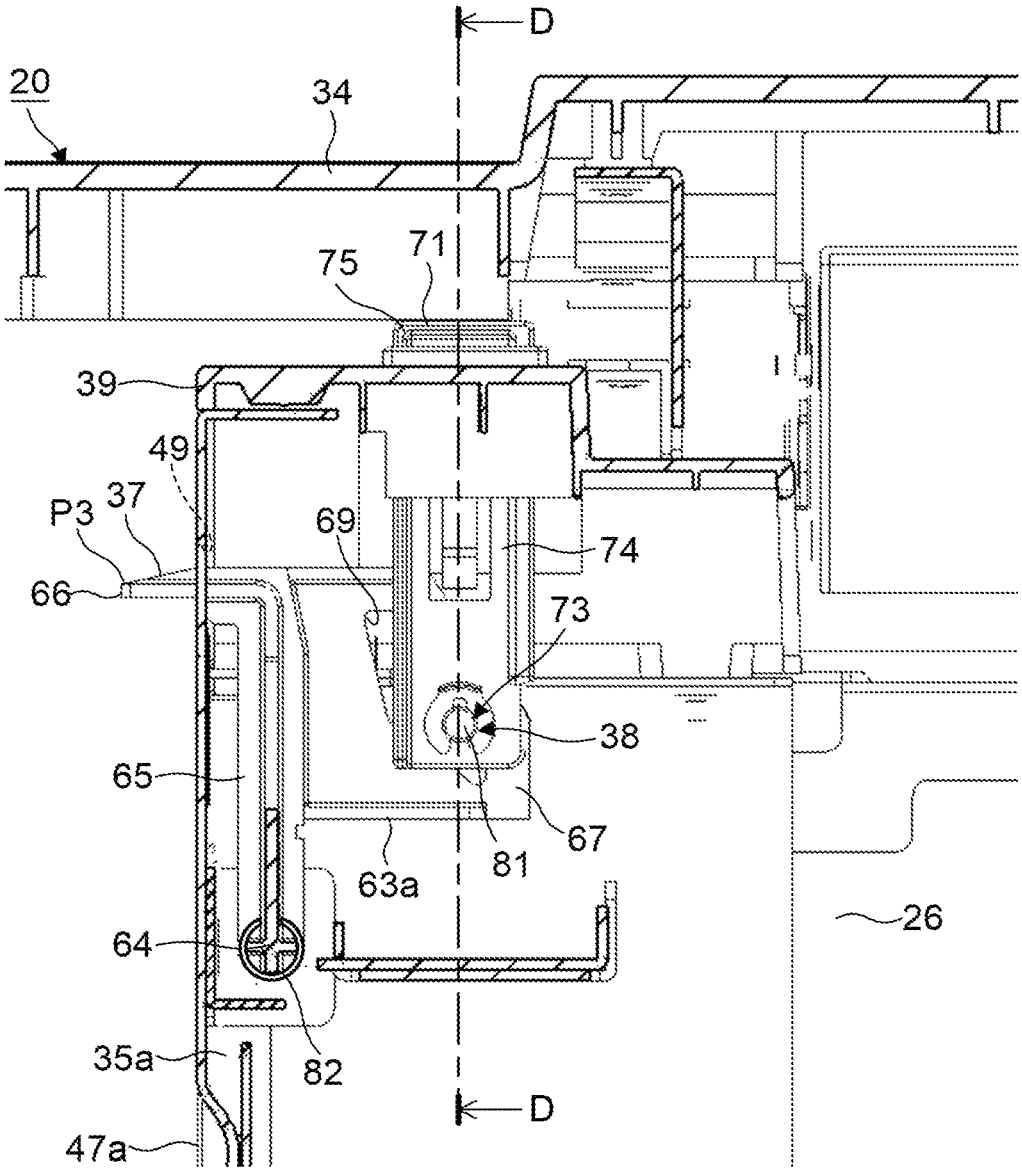
FIG. 6 is a cross-sectional view of the sheet storage apparatus as taken along a cross-section line C-C shown in FIG. 4.
Figure 7:
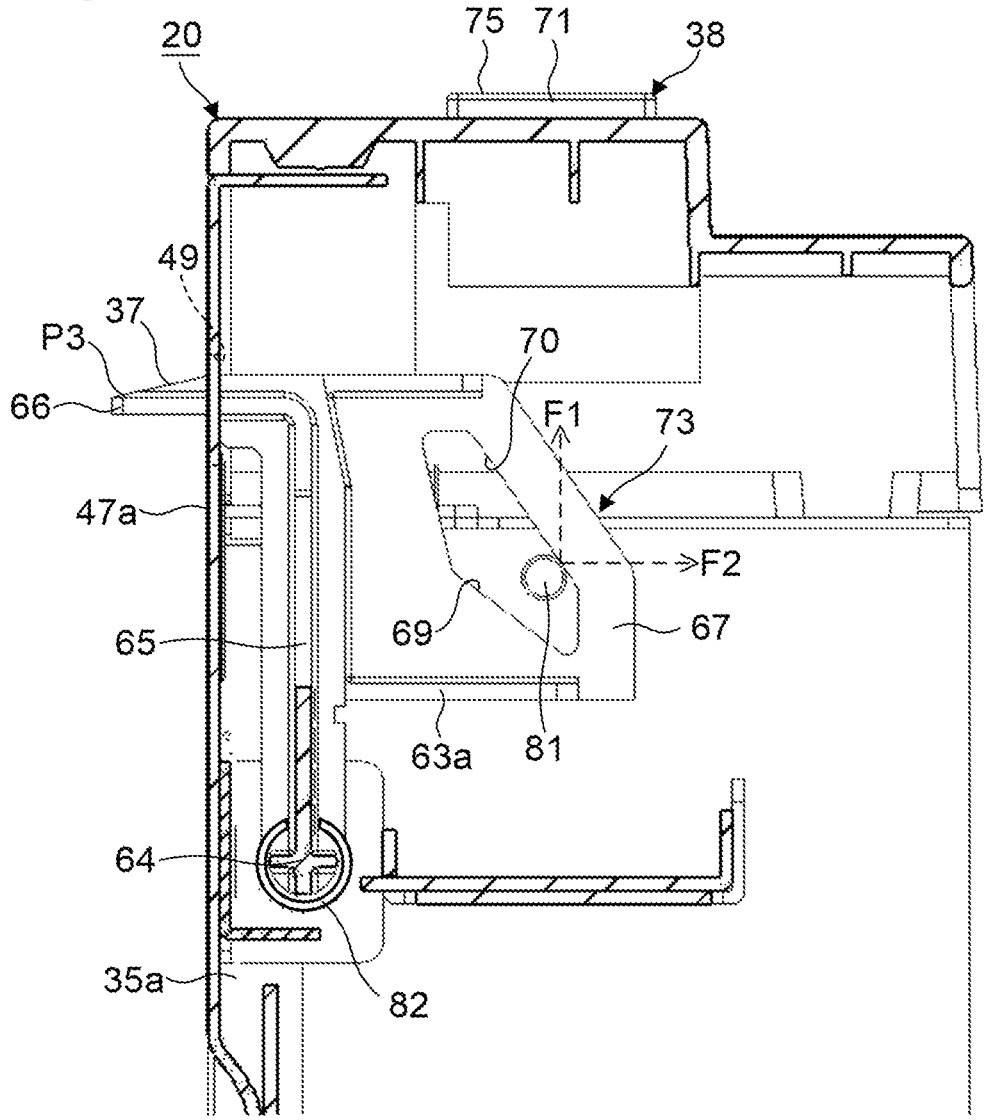
FIG. 7 is a cross-sectional view of the sheet storage apparatus from which an insertion portion is omitted.
Figure 8:
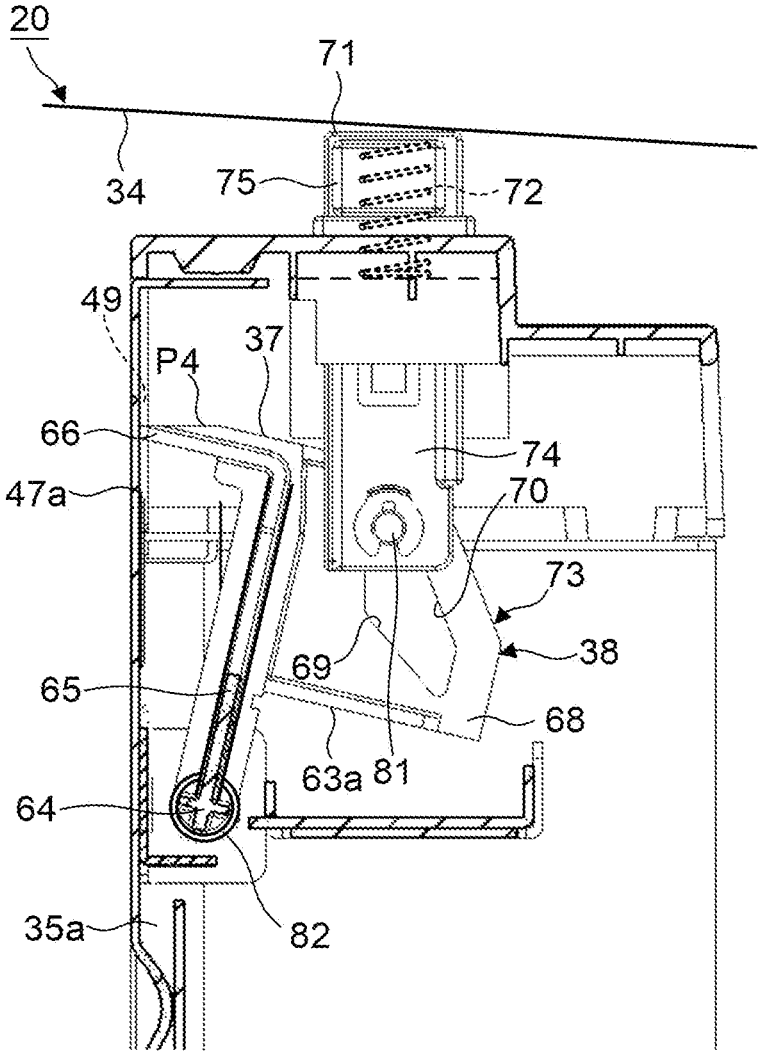
FIG. 8 is a cross-sectional view of the sheet storage apparatus under a state in which a sheet holding-down member has come to a retracted position.

FIG. 6 is a cross-sectional view of the sheet storage apparatus 20 as taken along a cross-section line C-C shown in FIG. 4. FIG. 7 is a cross-sectional view of the sheet storage apparatus 20 from which an insertion portion 74 is omitted. FIG. 8 is a cross-sectional view of the sheet storage apparatus 20 under a state in which the sheet holding-down member 37 has come to a retracted position P4. As illustrated in FIG. 5 to FIG. 7, the hook portion 63*a* includes an arm portion 65, a protruding portion 66, and a fin 67 (refer to FIG. 7). The hook portion 63*b* includes the arm portion 65 and the protruding portion 66 (refer to FIG. 5).

The arm portion 65 is fixed to the pivot shaft 64. The arm portion 65 extends straight along a radial direction of the pivot shaft 64. The protruding portion 66 is continuous with to a distal end of the arm portion 65 (an end portion on a side opposite to the pivot shaft 64). The protruding portion 66 is a bar-like part extending, orthogonal to the arm portion 65, inward in the sheet width direction along the circumferential direction of the pivot shaft 64. The protruding portion 66 and the protruding-portion passing hole 49 are disposed on a circumference of the same circle about the pivot shaft 64. When the pivot shaft 64 turns, the protruding portion 66 passes through the protruding-portion passing hole 49, or retracts from the protruding-portion passing hole 49.

The sheet holding-down member 37 is configured to be pivotable to a restricting position P3 and to the retracted position P4 about the pivot shaft 64. The restricting position P3 is a position of the sheet holding-down member 37 that has come to the inner side in the sheet width direction relative to the inner surface 47*a* (a side where the positioning edge portion 42 is present) (a position shown in FIG. 6 and FIG. 7).

Under the state in which the sheet holding-down member 37 has come to the restricting position P3, the protruding portion 66 is inserted in the protruding-portion passing hole 49. At this time, a distal end of the protruding portion 66 has come to the inner side in the sheet width direction relative to the inner surface 47*a* (the side where the positioning edge portion 42 is present). Under the state in which the sheet holding-down member 37 has come to the restricting position P3, the protruding portion 66 has come above a bottom rim of an outer peripheral surface of the pick-up roller 53 in the upward-and-downward direction (refer to FIG. 10).

Under a state in which the sheet holding-down member 37 has come to the restricting position P3, and in which the inner surface 47*a* is held in abutment against the side edges of the sheets S stacked on the sheet stacking tray 27, the protruding portion 66 faces the sheets S in the upward-and-downward direction. In this state, when the sheets S are floated by the blowing device 36, the top surface of the sheets S abuts against the protruding portion 66. With this, the floating of the sheets S is restricted (refer to FIG. 10).

The retracted position P4 is a position of the sheet holding-down member 37 that has retracted by pivoting from the restricting position P3 to the outer side in the sheet width direction (a position illustrated in FIG. 8), the position being on the outer side in the sheet width direction relative to the inner surface 47*a*. As illustrated in FIG. 8, under the state in which sheet holding-down member 37 has come to the retracted position P4, the protruding portion 66 has retracted to an outside of the protruding-portion passing hole 49 (the inside of the restricting cursor 35*a*). At this time, the distal end of the protruding portion 66 has come to the outer side in the sheet width direction relative to the inner surface 47*a* (a side opposite to the positioning edge portion 42).

As illustrated in FIG. 6 to FIG. 8, the fin 67 is a plate-like part that extends in a direction opposite to the protruding portion 66 with the arm portion 65 interposed therebetween. The fin 67 is continuous with a part corresponding to a predetermined area from the top end portion of the arm portion 65 to the pivot shaft 64. A shaft insertion hole 69 is formed through the fin 67. The shaft insertion hole 69 is a through-hole elongated in the upward-and-downward direction. An inclined surface 70 extending upward to be inclined to the inner side in the sheet width direction is formed as a part of an inner peripheral surface of the shaft insertion hole 69.

Figure 9:
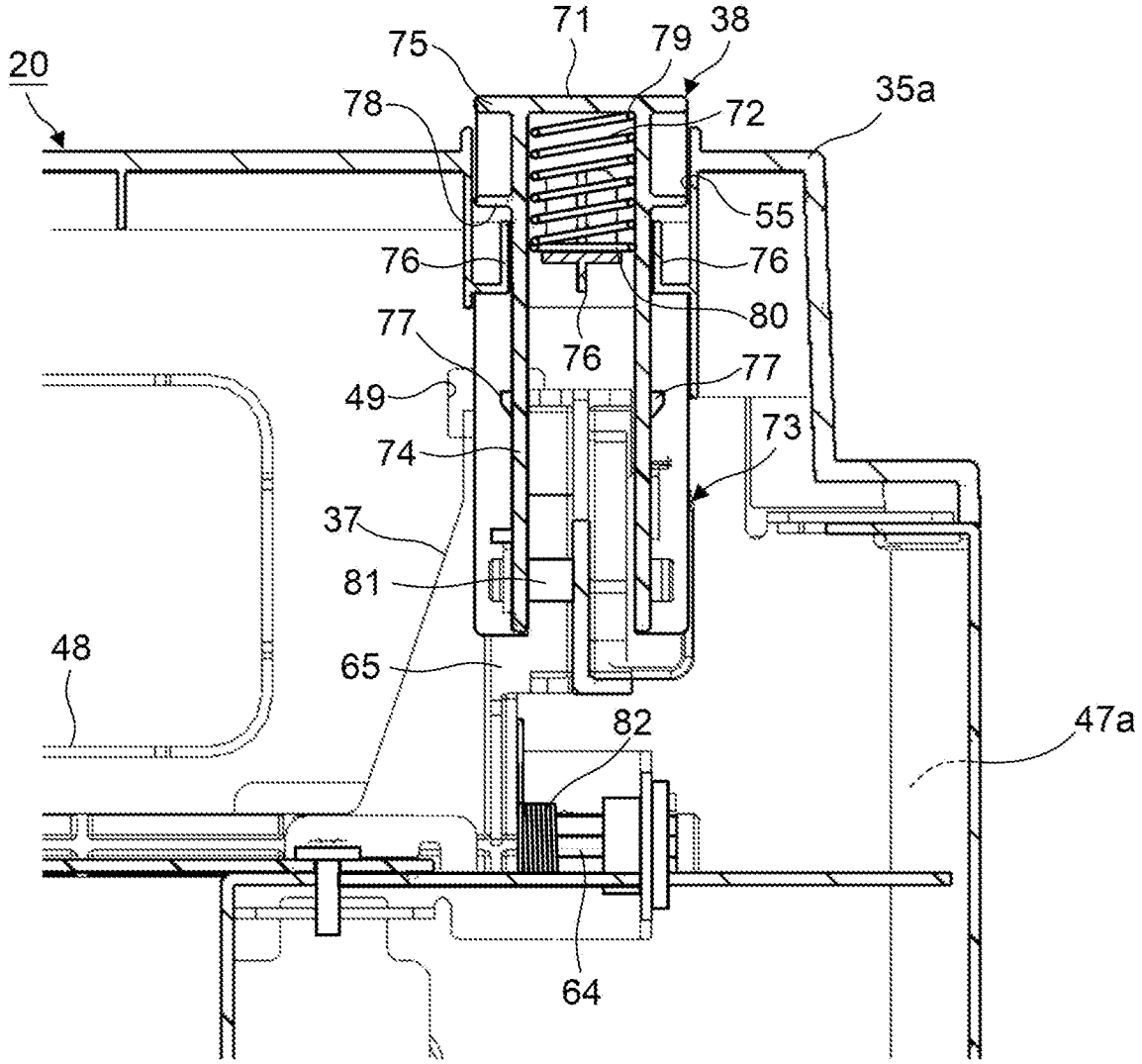
FIG. 9 is a cross-sectional view of the sheet storage apparatus as taken along a cross-section line D-D shown in FIG. 6.

FIG. 9 is a cross-sectional view of the sheet storage apparatus 20 as taken along a cross-section line D-D shown in FIG. 6. As illustrated in FIG. 9, the moving mechanism 38 is coupled to the sheet holding-down member 37. The moving mechanism 38 is a mechanism that moves the sheet holding-down member 37 to the restricting position P3 and to the retracted position P4. The moving mechanism 38 includes a push button 71, a first biasing member 72, and a link mechanism 73.

The push button 71 is a cubic bar-like body. The push button 71 is inserted in the button insertion hole 55, and is supported, by the restricting cursor 35*a*, to be capable of rising and sinking. The push button 71 includes the insertion portion 74 and an operating portion 75. The insertion portion 74 is a cubic bar-like part that extends downward from the operating portion 75 and that is radially smaller than the operating portion 75.

A positioning rib 76 that protrudes to an inside of the hole is provided on an inner peripheral surface of the button insertion hole 55. The insertion portion 74 is inserted into an inner side relative to the positioning rib 76. The insertion portion 74 slides relative to a distal end of the positioning rib 76. With this, rising and sinking of the insertion portion 74 is guided by the positioning rib 76. Positioning protrusions 77 that protrude in the sheet width direction are formed on side surfaces of the insertion portion 74.

The operating portion 75 is continuous with a top end of the insertion portion 74. An outer diameter of the operating portion 75 is larger than an outer diameter of the insertion portion 74, and is smaller than an inner diameter of the button insertion hole 55. The outer diameter of the operating portion 75 is larger than an interval between top end portions of the positioning rib 76. Thus, a bottom surface 78 of the operating portion 75 faces the positioning rib 76 in the upward-and-downward direction.

The first biasing member 72 is a coil spring. The first biasing member 72 is arranged between the positioning rib 76 and the operating portion 75. A bottom end portion 80 of the first biasing member 72 is held in abutment against the positioning rib 76, and a top end portion 79 of the first biasing member 72 is held in abutment against the operating portion 75. The first biasing member 72 biases the push button 71 in a rising direction.

When the push button 71 rises, the positioning protrusions 77 abut against the positioning rib 76 at a predetermined position. With this, the rising of the push button 71 is restricted, and the push button 71 is positioned in the rising direction. A position as a result of this positioning is defined as an operating position (a position illustrated in FIG. 8).

Under a state in which the operating portion 75 has come to the operating position, when the top cover 34 is moved from the opening position P2 to the closing position P1, as illustrated in FIG. 8, at a position corresponding to a predetermined turning angle, the operating portion 75 comes into contact with the rear surface of the top cover 34. When the top cover 34 is lowered further in this state toward the closing position P1, the top cover 34 pushes the push button 71 against biasing force of the first biasing member 72. When the top cover 34 reaches the closing position P1, as illustrated in FIG. 6, the push button 71 abuts against the top cover 34. With this, the movement in the rising direction of the push button 71 is restricted, and the push button 71 is positioned. A position as a result of this positioning is defined as a pushed position (a position illustrated in FIG. 6, FIG. 7, and FIG. 9).

As illustrated in FIG. 7 to FIG. 9, the link mechanism 73 includes a coupling shaft portion 81, a second biasing member 82, the above-described pivot shaft 64, and the above-described shaft insertion hole 69. The coupling shaft portion 81 is a bar-like body that is provided through the insertion portion 74 and that is perpendicular to the sheet width direction. The coupling shaft portion 81 is inserted in the shaft insertion hole 69. The coupling shaft portion 81 faces the inner peripheral surface of the shaft insertion hole 69 in a radial direction of the coupling shaft portion 81.

Under the state in which the push button 71 has come to the pushed position, the movement in the rising direction of the push button 71 is restricted by the top cover 34. Thus, the coupling shaft portion 81 is not held in abutment against the inclined surface 70, or even when in abutment, the biasing force of the first biasing member 72 is not applied to the inclined surface 70.

When the top cover 34 is moved from the closing position P1 to the opening position P2, the push button 71 rises by the biasing force of the first biasing member 72. In conjunction with the rising of the push button 71, the coupling shaft portion 81 rises integrally with the insertion portion 74. At this time, the coupling shaft portion 81 abuts against the inclined surface 70, and slides from bottom up along the inclined surface 70. With this, the coupling shaft portion 81 pushes the fin 67 upward through intermediation of the inclined surface 70. Pushing force at this time is divided by the inclined surface 70 into upward component force F1 (an upward arrow in FIG. 7) and component force F2 toward the outer side in the sheet width direction (a right-pointing arrow in FIG. 7).

The second biasing member 82 is a torsional spring in which the pivot shaft 64 is inserted. The second biasing member 82 biases the arm portion 65 along the circumferential direction of the pivot shaft 64. An orientation of biasing force of the second biasing member 82 is opposite to an orientation of the above-mentioned component force F2. The biasing force of the second biasing member 82 is smaller than the component force F2.

As described above, under the state in which the top cover 34 has come to the closing position P1, the push button 71 is positioned in the rising direction, and the biasing force of the first biasing member 72 is not applied to the inclined surface 70. Thus, the component force F2 is not generated, and the sheet holding-down member 37 is maintained at the restricting position P3 by the biasing force of the second biasing member 82.

When the top cover 34 is moved from the closing position P1 to the opening position P2, the component force F2 is generated as mentioned above. Thus, the first biasing member 72 causes the sheet holding-down member 37 to move to the retracted position P4 against the biasing force of the second biasing member 82.

Figure 10:
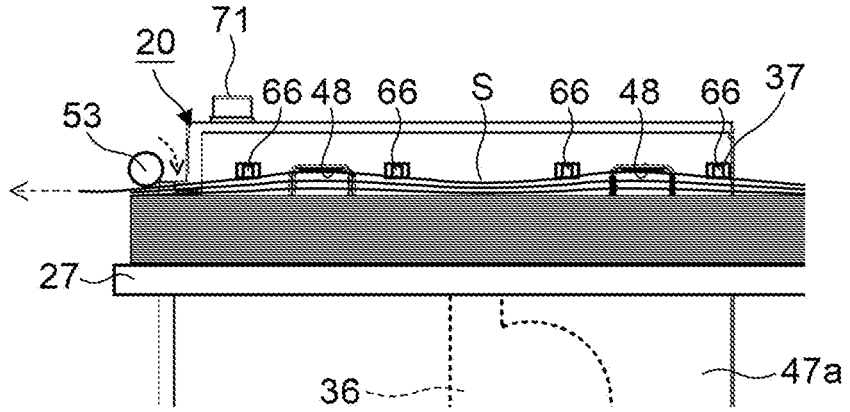
FIG. 10 is a side view of sheets stacked on the sheet stacking tray in a stacking state.

FIG. 10 is a side view of the sheets S stacked on the sheet stacking tray 27 in a stacking state. In FIG. 10, the sheet holding-down member 37 has come to the restricting position P3.

As illustrated in FIG. 10, under the state in which the sheet holding-down member 37 has come to the restricting position P3, when the blowing device 36 blows air to the sheets S, the sheets S float. As described above, the vents 48 are disposed at the positions overlapping with the pick-up roller 53 in the upward-and-downward direction. Thus, in the bundle of the sheets S stacked on the sheet stacking tray 27, several ones of the sheets S float, the several ones having come relatively near the pick-up roller 53 in the upward-and-downward direction. Then, a topmost one of the floating sheets S abuts against the protruding portions 66, and is positioned at the sheet feeding position. In this state, when the pick-up roller 53 rotates, the sheet S at the sheet feeding position is fed to the downstream side (the side where the image forming apparatus 1 is present) in the sheet conveying direction.

As described above, when the top cover 34 is moved to the opening position P2, the sheet holding-down member 37 is moved to the retracted position P4. The retracted position P4 of the sheet holding-down member 37 is on the outer side in the sheet width direction relative to the inner surface 47*a*. Thus, at the time when the sheets S are supplied onto the sheet stacking tray 27, the sheets S are prevented from coming into contact with the sheet holding-down member 37. Further, under the state in which the top cover 34 has come to the opening position P2, the sheet holding-down member 37 does not move to an outside of the sheet storage section 33, and hence is inaccessible to users. With this, the sheet holding-down member 37 can be suppressed from hindering the supply of the sheets S, and damage to the sheet holding-down member 37 can be suppressed.

Thus, it is possible to provide the sheet storage apparatus 20 in which hindrance to the supply of the sheets S is suppressed, and in which occurrence of failures in sheet feeding is prevented.

Further, as described above, two of the protruding portions 66 are arranged on both sides in the sheet conveying direction of each of the vents 48. Thus, when the sheets S are floated by the blowing device 36, the floated sheets S swell into a shape of mountains with their tops overlapping with the vents 48 in the sheet conveying direction. With this, air easily flows through these swelling parts, which causes the sheets S to easily float all over in the sheet width direction. In this way, the sheets S are easily and satisfactorily positioned to the feeding position, and the failures in feeding the sheets S can be suppressed.

Still further, as described above, the moving mechanism 38 causes the sheet holding-down member 37 to pivot in conjunction with the opening-and-closing movements of the top cover 34. Thus, it is unnecessary, for example, to provide a drive source such as a motor for pivoting the sheet holding-down member 37, or to control the pivot of the sheet holding-down member 37. In this way, with a simple configuration, it is possible to suppress the failures in feeding the sheets S, and to suppress the hindrance to the supply of the sheets S.

In addition, the present disclosure is not limited to the above-described embodiment, and may be variously modified without departing from the gist of the present disclosure. For example, although the sheet holding-down member 37 according to the above-described embodiment is configured to be supported by the restricting cursor 35*a*, another configuration in which the sheet holding-down member 37 is supported by both the restricting cursors 35*a* and 35*b*, or a still another configuration in which the sheet holding-down member 37 is supported only by the restricting cursor 35*b* may be adopted. In this case, the moving mechanism 38 and the blowing device 36 are also provided in the restricting cursor 35*b*.

Further, the configuration in which the sheet holding-down member 37 according to the above-described embodiment includes the one hook portion 63*a* and the three hook portions 63*b* need not necessarily be adopted. For example, a yet another configuration in which the sheet holding-down member 37 includes a plurality of hook portions 63*a* may be adopted. In this case, a configuration in which the coupling shaft portion 81 is inserted in the shaft insertion holes 69 that are formed respectively through the fins 67 of the hook portions 63*a* may be adopted.

The present disclosure can be utilized as a high-capacity sheet storage apparatus capable of storing sheets to be fed to an image forming apparatus. By utilizing the present disclosure, failures in feeding the sheets from the sheet storage apparatus to the image forming apparatus can be suppressed.

In addition, the present disclosure is applicable not only to the feeding of the sheets S in the sheet storage section 33 in the sheet storage apparatus 20, and is applicable also to the feeding of the sheets S in the sheet feeding section 2 in the body of the image forming apparatus 1.

The present disclosure can be utilized as the high-capacity sheet storage apparatus capable of storing the sheets to be fed to the image forming apparatus. By utilizing the present disclosure, it is possible to provide an image forming system and the image forming apparatus that are capable of suppressing the failures in feeding the sheets from the sheet storage apparatus to the image forming apparatus.

What is claimed is:

1. A sheet storage apparatus, comprising:

an apparatus body;

a sheet storage section including a sheet supply port that is formed at a top of the apparatus body, and a sheet stacking portion that is capable of stacking sheets, the sheets being capable of being stacked onto the sheet stacking portion through the sheet supply port;

a top cover supported by the apparatus body so as to be pivotable between an opening position at which the sheet supply port is opened and a closing position at which the top cover closes the sheet supply port by turning at a predetermined angle from the opening position;

a sheet feeding section that is provided above the sheet storage section, and that is configured to feed, at a predetermined feeding position, the sheets stacked on the sheet stacking portion toward a downstream side in a sheet conveying direction by abutting against the sheets;

a restricting cursor that is arranged, in the sheet storage section, at a predetermined position in a sheet width direction orthogonal to the sheet conveying direction, that has an abutment surface which abuts against side edges of the sheets, and that is configured to restrict movements in the sheet width direction of the sheets stacked on the sheet stacking portion;

a blowing device including a fan that is provided in the restricting cursor, and that is configured to generate airflow, and a vent that is formed through the abutment surface, and that is configured to exhaust the airflow, the blowing device being configured to blow the airflow to be exhausted through the vent to one of the sheets stacked on the sheet stacking portion, the one of the sheets having come near the predetermined feeding position, to thereby float the one of the sheets;

a sheet holding-down member that is supported to be pivotable by the restricting cursor, and that includes a restricting piece which is configured to restrict a floating height of the one of the sheets by coming into contact with a top surface of the one of the sheets by protruding from the abutment surface of the restricting cursor to an inner side in the sheet width direction; and a moving mechanism that is coupled to the sheet holding-down member, that is configured to move the sheet holding-down member to a restricting position by coming into contact with the top cover under a state in which the top cover in the closing position, the restricting position being a position of the sheet holding-down member that has protruded from the abutment surface, and that is configured to move the sheet holding-down member from the abutment surface to a retracted position by separating from the top cover a state which the top cover is in the opening position, the retracted position being on an outer side in the sheet width direction and being a position of the sheet holding-down member that has retracted.

2. The sheet storage apparatus according to claim 1, wherein the restricting piece includes a protruding portion that is arranged on each side in the sheet conveying direction of the vent, and that is configured to protrude from the abutment surface of the restricting cursor under a state in which the sheet holding-down member is in the restricting position, to abut against the top surface of the one of the sheets.

3. The sheet storage apparatus according to claim 1, wherein the moving mechanism includes an operating portion that is provided to be movable up and down between a first position of the operating portion that has protruded from a top surface of the restricting cursor, and a second position of the operating portion that has retracted from the top surface, a link mechanism that is coupled to the operating portion and the sheet holding-down member, that is configured to move the sheet holding-down member to the restricting position when the operating portion is lowered, and that is configured to move the sheet holding-down member to the retracted position when the operating portion is rised, and a first biasing member that is configured to bias the operating portion to the first position, wherein, when the top cover is moved from the opening position to the closing position, the moving mechanism comes into contact with the operating portion at the first position, and pushes the operating portion against biasing force of the first biasing member, to thereby cause, at the closing position, the sheet holding-down member to be arranged at the restricting position.

4. The sheet storage apparatus according to claim 3, wherein the sheet holding-down member pivots between the restricting position and the retracted position about a pivot shaft that extends in the sheet conveying direction, wherein the link mechanism includes a shaft insertion hole that is formed through the sheet holding-down member, a coupling shaft portion that is provided through the operating portion, that extends in the sheet conveying direction, that is inserted in the shaft insertion hole, and that moves in the shaft insertion hole, and a second biasing member that is configured to bias the sheet holding-down member to the restricting position in a pivoting direction about the pivot shaft, and that has biasing force smaller than the biasing force of the first biasing member, wherein, in the link mechanism, under a state in which the operating portion has been pushed, the coupling shaft portion separates from an inner peripheral surface of the shaft insertion hole, to thereby cause the sheet holding-down member to be moved to the restricting position by the biasing force of the second biasing member, and under a state in which the operating portion has avoided being pushed, the coupling shaft portion is moved up by the biasing force of the first biasing member, and slides along the inner peripheral surface of the shaft insertion hole, to thereby cause the sheet holding-down member to be moved to the retracted position against the biasing force of the second biasing member.

5. The sheet storage apparatus according to claim 4, wherein the shaft insertion hole is formed through the restricting piece, wherein the restricting piece of the sheet holding-down member includes a plurality of restricting pieces that are arrayed along the sheet conveying direction, wherein the vent includes a plurality of vents that are arranged along the sheet conveying direction, and wherein, in the link mechanism, the coupling shaft portion is inserted in the shaft insertion holes of the plurality of restricting pieces, to thereby cause the sheet holding-down member to move in conjunction with the pushing of the operating portion.

6. The sheet storage apparatus according to claim 1, wherein the vent is formed through the abutment surface of the restricting cursor on the downstream side in the sheet conveying direction near the predetermined feeding position, and wherein the blowing device includes a duct that is connected to the fan and that communicates to the vent through an inside of the restricting cursor.

7. An image forming apparatus, comprising:

the sheet storage apparatus according to claim 1;

an image forming section that is configured to form images onto the sheets; and a sheet conveying path that is configured to convey the sheets to the image forming section, the sheet feeding section feeding the sheets to the sheet conveying path.

8. An image forming system, comprising:

the sheet storage apparatus according to claim 1; and an image forming apparatus including an image forming section that is configured to form images onto the sheets, the sheet storage apparatus being connected to the image forming apparatus, and feeding the sheets to the image forming section.

* * * * *